US012690668B2

(12) United States Patent
Köder

(10) Patent No.: US 12,690,668 B2
(45) Date of Patent: Jul. 28, 2026

(54) TELESCOPIC COLUMN FOR A HEIGHT-ADJUSTABLE TABLE AND HEIGHT-ADJUSTABLE TABLE HAVING SUCH A TELESCOPIC COLUMN

(71) Applicant: Kesseböhmer Holding KG, Bad Essen (DE)

(72) Inventor: Michael Köder, Plochingen (DE)

(73) Assignee: KESSEBÖHMER HOLDING KG, Bad Essen (DE)

( * ) Notice: Subject to any disclaimer, the term of this patent is extended or adjusted under 35 U.S.C. 154(b) by 58 days.

(21) Appl. No.: 18/108,933

(22) Filed: Feb. 13, 2023

(65) Prior Publication Data

US 2023/0276937 A1 Sep. 7, 2023

(30) Foreign Application Priority Data

Dec. 14, 2021 (DE) ..... 102021214325.3

(51) Int. Cl.
*A47B 9/20* (2006.01)

(52) U.S. Cl.
CPC ..... *A47B 9/20* (2013.01)

(58) Field of Classification Search
CPC ..... A47B 9/20; Y10T 403/32467; Y10T 403/7077; F16M 11/28; F16B 7/10; F16B 7/1436
See application file for complete search history.

(56) References Cited

U.S. PATENT DOCUMENTS 1,359,790 A * 11/1920 Campbell ..... B66C 23/20 248/161
2,225,929 A * 12/1940 Roland ..... F16F 15/14 74/574.3
2,422,774 A * 6/1947 Conner ..... F16C 33/40 384/30
2,846,278 A * 8/1958 Blazek ..... B21D 37/10 108/147.19

(Continued)

FOREIGN PATENT DOCUMENTS

CH 438620 A 6/1967
DE 1059642 A * 3/1954

(Continued)

*Primary Examiner* — Kimberly T Wood

(57) ABSTRACT

A telescopic column for a height-adjustable table comprises a cylindrical outer column, a cylindrical inner column at least partially arranged within the outer column, several balls, and a tube-shaped ball cage retaining the balls at positions relatively determined with respect to one another. The outer column comprises, along its longitudinal direction on its inside, an outer column running surface section configured such that the balls roll over thereon, the inner column comprises, along its longitudinal direction on its outer cross-section, an inner column running surface section configured such that the balls roll over thereon, and the inner column and the outer column are configured such that the balls, during an adjustment of a length of the telescopic column, roll over in an almost backlash-free manner on the outer column running surface section and the inner column running surface section in a predefined range of motion of the balls in order to guide the inner column in the outer column.

20 Claims, 5 Drawing Sheets

(56) References Cited

U.S. PATENT DOCUMENTS

| | | | | | |
|---|---|---|---|---|---|
| 3,285,207 | A * | 11/1966 | Heinz-Gunther Von Hagen | A47B 9/083 108/150 |
| 3,521,341 | A * | 7/1970 | Reinhard | F16M 11/28 29/434 |
| 6,378,816 | B1 * | 4/2002 | Pfister | F16C 29/04 248/161 |
| 8,011,308 | B2 * | 9/2011 | Picchio | A47B 9/04 248/404 |
| 10,342,327 | B2 * | 7/2019 | Lin | A47B 9/10 |
| 10,512,334 | B1 * | 12/2019 | Koh | A47C 3/30 |
| 2002/0050112 | A1 * | 5/2002 | Koch | F16C 33/3856 52/651.07 |
| 2003/0173479 | A1 * | 9/2003 | Garelick | B63B 29/06 248/188.5 |
| 2018/0303233 | A1 * | 10/2018 | DeGroot | A47B 9/20 |
| 2020/0132116 | A1 * | 4/2020 | Walling | F16C 29/02 |

FOREIGN PATENT DOCUMENTS

| | | | | | |
|---|---|---|---|---|---|
| DE | 218311 | B | * | 11/1961 | |
| DE | 1962623 | U | | 6/1967 | |
| DE | 2737104 | C2 | * | 4/1985 | |
| DE | 19623437 | A1 | | 1/1998 | |
| DE | 202009011272 | U1 | | 2/2010 | |
| DE | 102009045707 | A1 | | 4/2011 | |
| FR | 1278851 | A | | 12/1961 | |
| WO | WO-9747217 | A1 | * | 12/1997 | A47B 9/20 |

* cited by examiner

TELESCOPIC COLUMN FOR A HEIGHT-ADJUSTABLE TABLE AND HEIGHT-ADJUSTABLE TABLE HAVING SUCH A TELESCOPIC COLUMN

RELATED APPLICATION

The present application is based on and claims priority under 35 U.S.C. § 119 to German Patent Application No. DE 10 2021 214 325.3, filed Dec. 14, 2021 the complete disclosure of which is hereby expressly incorporated by reference.

BACKGROUND

The invention relates to a telescopic column for a height-adjustable table and a height-adjustable table having such a telescopic column, in particular, to a telescopic column having a circular cross-section.

In the state-of-the-art, telescopic columns for height-adjustable tables having a rectangular, particularly square, design are known. In order to reduce a force for extracting and retracting these telescopic columns and, therefore, the force for a height adjustment of a tabletop, roller guides are employed instead of also usual sliding guides. Thereby, a friction value can reduced about a factor 10. This low friction value enables a convenient operation of the height adjustment with low displacement force.

However, for design reasons it is desirable that not only telescopic columns having a rectangular design but, particularly in tables having only one telescopic column and one circular tabletop, telescopic columns having a circular cross-section are used. However, in the state-of-the-art, such telescopic columns having a circular cross-section are merely equipped with sliding guides since the use of roller guides creates problems in view of a radial alignment and a backlash-free alignment of the tabletop with respect to a table foot.

BRIEF SUMMARY

Therefore, the object underlying the invention is to provide a telescopic column having a circular cross-section for a height-adjustable table, which telescoping column enables low displacement forces for a height adjustment of the table.

This object is achieved by a telescopic column according to claim 1 and a height-adjustable table according to claim 15. Advantageous further developments are included in the dependent claims.

According to an aspect of the invention, a telescopic column for a height-adjustable table comprises a cylindrical outer column, a cylindrical inner column arranged at least partially within the outer column, several balls, and a tube-shaped ball cage configured to retain the balls in predetermined positions. Along its longitudinal direction on its inside, the outer column comprises an outer column running surface section configured such that the balls roll over thereon, and along its longitudinal direction on its outer cross-section, the inner column comprises an inner column running surface section configured such that the balls roll over thereon, and the inner column and the outer column are configured such that, during an adjustment of a length of the telescoping column in a predefined range of motion of the balls on the outer column running surface section and the inner column running surface section, the balls roll over almost backlash-free in order to guide the inner column in the outer column.

With such a telescopic column, it is possible to the keep the displacement forces low in order to enable a height adjustment of a height-adjustable table with low displacement forces.

In this context, the cylindrical shape of the other column and of the inner column imply that they respectively comprise a circular outer cross-section. Nevertheless, in the outer cross-section of the inner column, orifices or dents can also be provided which, however, are configured such that they are not visible when the height-adjustable table is used.

The outer column running surface section and the inner column running surface section each have properties such that the balls can roll over in a suitable manner. These properties include a suitable roughness and/or hardness of the surface that allows the balls to roll smoothly without denting when a lateral load or moment load is applied to the telescopic column. In particular, for ensuring these properties, no coating on the inner column running surface section is provided.

Further, the outer column running surface section and the inner column running surface section are arranged or dimensioned such that the balls can roll over almost backlash-free within the predefined range of motion, namely, within the range in which the balls move for a maximum determined adjustment stroke of the telescopic column. This means that the outer column running surface section and the inner column running surface section are parallel with respect to one another and the distance is in a tolerance range such that a possible small backlash or almost no backlash, nevertheless, no jamming, can occur.

The tube-shaped ball cage has a cylindrical cross-section. Further, it comprises orifices in which the balls are accommodated or arranged such that they project on the inside as well as on the outside. By the orifices, the balls are retained at a defined distance, in particular, in a longitudinal direction of the tube-shaped ball cage.

In an advantageous further development of the telescopic column, distributed on its circumference, the outer column running surface section comprises at least two longitudinal grooves along the longitudinal direction of the outer column, which grooves are respectively configured such that the balls can roll over in the longitudinal grooves during the adjustment within the range of motion.

By the provision of the at least two longitudinal grooves, it is not necessary to design the entire inner cross-section of the outer column such that it is suitable for rolling over of the balls which facilitates the manufacturing of the outer column.

According to a further advantageous further development of the telescopic column, a shape and dimensions of the longitudinal grooves within the range of motion of the balls as well as the diameter of the balls are configured such that, during the adjustment of the length of the telescopic column, one of the balls contacts one of the longitudinal grooves at two points.

By the fact that the balls contact the longitudinal grooves of the outer column running surface section respectively at two points, wherein the balls also contact the inner column running surface sections, a motion of the balls lateral with respect to a longitudinal direction of the longitudinal grooves is hardly possible such that a twisting of the outer column with respect to the inner column is not or only hardly possible. Thereby, it's possible to ensure a steady alignment of the other column with respect to the inner column in a backlash-free manner.

According to a further advantageous further development of the telescopic column, the inner column comprises at least one guiding element configured to engage into one of the longitudinal grooves in an almost backlash-free manner during the adjustment of the length of the telescopic column along the adjustment stroke of the telescopic column in order to align the in the column with respect to the outer column.

In order to engage into one of the longitudinal grooves, the guiding element projects from the outer cross-section of the inner column so much that it can project into one of the longitudinal grooves. A width of the guiding element in a circumferential direction around the cylindrical inner column is attuned with a shape of the longitudinal groove such that the guiding element can be moved in direction of the length of the outer column with a very low backlash or backlash-free in the circumferential direction in the longitudinal groove without jamming so that a steady alignment of the outer column with respect to the inner column can be ensured in a backlash-free manner, i.e., a twisting of the columns with respect to one another can surely be prevented.

In a further advantageous further development of the telescopic column, several guiding elements are provided which are configured such that, during the adjustment along the adjustment stroke of the telescopic column, they engage into at least one of the longitudinal grooves in a backlash-free manner.

By the provision of several guiding elements, a lateral force, which can occur, e.g., when relocating or twisting the height-adjustable table and which has an effect to the inner column as a circumferential force, can be distributed to the individual guiding elements and, therefore, it can be reduced for each individual guiding element.

According to a further advantageous further development of the telescopic column, the several guiding elements are integrally connected to one another and they are configured to generate a guiding ring.

By the integral design, it is not necessary to individually attach several guiding elements to the inner column so that the assembly is facilitated. Further, the provision of the guiding ring enables a facilitated alignment of the guiding elements with respect to the inner column.

In a further advantageous further development of the telescopic column, the inner column comprises a recess, the guiding ring comprises a radial protrusion, and the recess and the radial protrusion are configured to engage into one another.

By the engaging of the radial protrusion into the recess, on the one hand, an alignment of the guiding ring with respect to the inner column can be ensured easily, nevertheless, on the other hand, there is the possibility to fasten the guiding ring to the inner column by means of the radial protrusion and the recess. Thereby, the radial protrusion projects from the guiding ring in direction of the inner column and the inner column comprises a recess formed such that the protrusion can be accommodated therein. Alternatively, the protrusion and the recess can be interchanged at the elements.

In a further advantageous implementation, the guiding ring comprises an at least partially circumferential, radially protruding rim and the guiding elements are integrated in the rim.

By the provision of the rim, a stiffness of the guiding ring can be increased, wherein there is also the possibility that a length of the guiding elements engaging into the grooves of the outer column running surface section, therefore, radially protruding from the rim, can be shortened in order to also increase their stiffness.

According to a further advantageous implementation of the telescopic column, it is configured such that the rim of the guiding ring abuts against one end face of the inner column and the radial protrusion comprises a snap-in nose configured to engage with the recess of the inner column such that the guiding ring is positively held in the longitudinal direction of the inner column by means of the rim and the snap-in nose.

Thereto, the rim of the guiding ring has an inner diameter which is smaller than an outer diameter of the inner column and an outer diameter of the guiding ring is larger than the outer diameter of the inner column. At a distance from the rim in a longitudinal direction of the inner column, the guiding ring is provided with the snap-in nose and the inner column is provided with the recess at a distance which is chosen such that the snap-in nose can enter into recess. In particular, the distances are chosen such that the guiding ring is retained positively in the longitudinal direction of the inner column by the inserting of the snap-in nose into the recess, wherein an easy fastening of the guiding ring on the inner ring is possible.

In a further advantageous further development of the telescopic column, the inner column comprises a further recess, the guiding ring comprises a further radial protrusion additionally to the radial protrusion and the further recess and the further radial protrusion are configured to engage into one another in order to positively align the guiding ring with respect to the in the column.

Thereby, the further recess of the inner column and the further radial protrusion of the guiding ring are arranged at positions enabling that the further radial protrusion and the further recess engage in a backlash-free manner in the circumferential direction. Advantageously, in the circumferential direction, the width of the protrusion is accordingly dimensioned with respect to the width of the recess that they are basically backlash-free. Thereby, in the case in which the recess and the radial protrusion are used for retaining the guiding ring on the inner column, an alignment of the guiding ring with respect to the inner column can easily be realized additionally. In the case of the retaining of the guiding ring by the recess and the radial protrusion, however, a sure engagement into one another of these components is necessary. However, when these components are dimensioned such that these components are backlash-free, there is the risk that their engagement and, therefore, the retaining of the guiding ring is not safely possible. Therefore, between the radial protrusion and the recess, a sufficient backlash is provided and the backlash-free alignment is realized by the further recess and the further protrusion.

In another advantageous further development of the telescopic column, it is configured such that, when the length of the telescopic column is enlarged, hence, when the telescopic column is extracted, the ball cage can abut against the rim.

The telescopic column and, in particular, its components, namely, the tube-shaped ball cage, the inner column, the outer column, and the guiding ring of the telescopic column enable the abutment of the ball cage against the rim of the guiding ring. The tube-shaped ball cage is arranged in a gap between the inner column and the outer column in order to retain the balls at positions predetermined relatively with respect to one another, wherein the positions are chosen such that the balls roll over in a backlash-free manner on the outer column running surface section and the inner column running surface section. Since the outer diameter of the guiding ring attached to the inner column is larger than the outer diameter of the inner column, the guiding ring projects into this gap. Therefore, when the ball cage is displaced with respect to the inner column which can occur additionally to the rolling over of the balls, the ball cage abuts against the radial rim of the guiding ring. In the mounted state with the outer column downside, such an additional displacement of the ball cage can occur by the gravitational force due to slip of the balls. By the abutting of the ball cage against the rim of the guiding ring, however, it can be ensured that the balls roll over within the predefined range of motion on the outer column running surface section and the inner column running surface section.

In a further advantageous further development of the telescopic column, it further comprises a tube-shaped cover element which is provided separately or, preferably, connected with the ball cage and which is configured to cover the inner column running surface section in an extracted state of the telescopic column.

Thereby, the advantage that the inner column running surface section is not visible in the extracted state and the optical impression of the telescopic column is not impaired is achieved.

The tube-shaped cover element has an inner diameter which is slightly larger than the outer diameter of the inner column and an outer diameter which is smaller than an inner longitudinal hole of the outer column so that it can move between the inner column and the outer column. A point on a circumference of a circle currently being opposite from a contact point of the circle contacting a surface, compared to a center of the circle, moves with a double velocity when the circle rolls over the surface due to the double distance from the contact point. Because of this effect and because of the connection with the ball cage, the cover element together with the ball cage moves half of an adjustment stroke of the inner column with respect to the outer column in the same direction as the inner column since the balls retained by the ball cage roll over the outer column. Thereby, it is possible to cover the inner column running surface section such that it is not visible also in case of an extracted telescope column.

In an advantageous further development of the telescope column, the cover element and the ball cage are formed as an integral part.

The integral provision of the cover element and the ball cage as the integral part enables an easier handling and also an easier mounting of the telescopic column.

In a further advantageous further development of the telescopic column, the cover element and the ball cage are manufactured of the same material.

The use of the same material for the integrally provided cover element and ball cage enables an economic manufacturing of this element that fulfills two functions, namely, the guiding of the balls as well as the covering of the inner column running surface section in the extracted state of the telescopic column.

According to a further aspect of the invention, a height-adjustable table comprises a telescopic column.

BRIEF DESCRIPTION OF THE DRAWINGS

Subsequently, the invention is elucidated by means of embodiments referring to the attached drawings.

In particular.

DETAILED DESCRIPTION OF THE DRAWINGS AND THE PRESENTLY PREFERRED EMBODIMENTS

Figure 1:
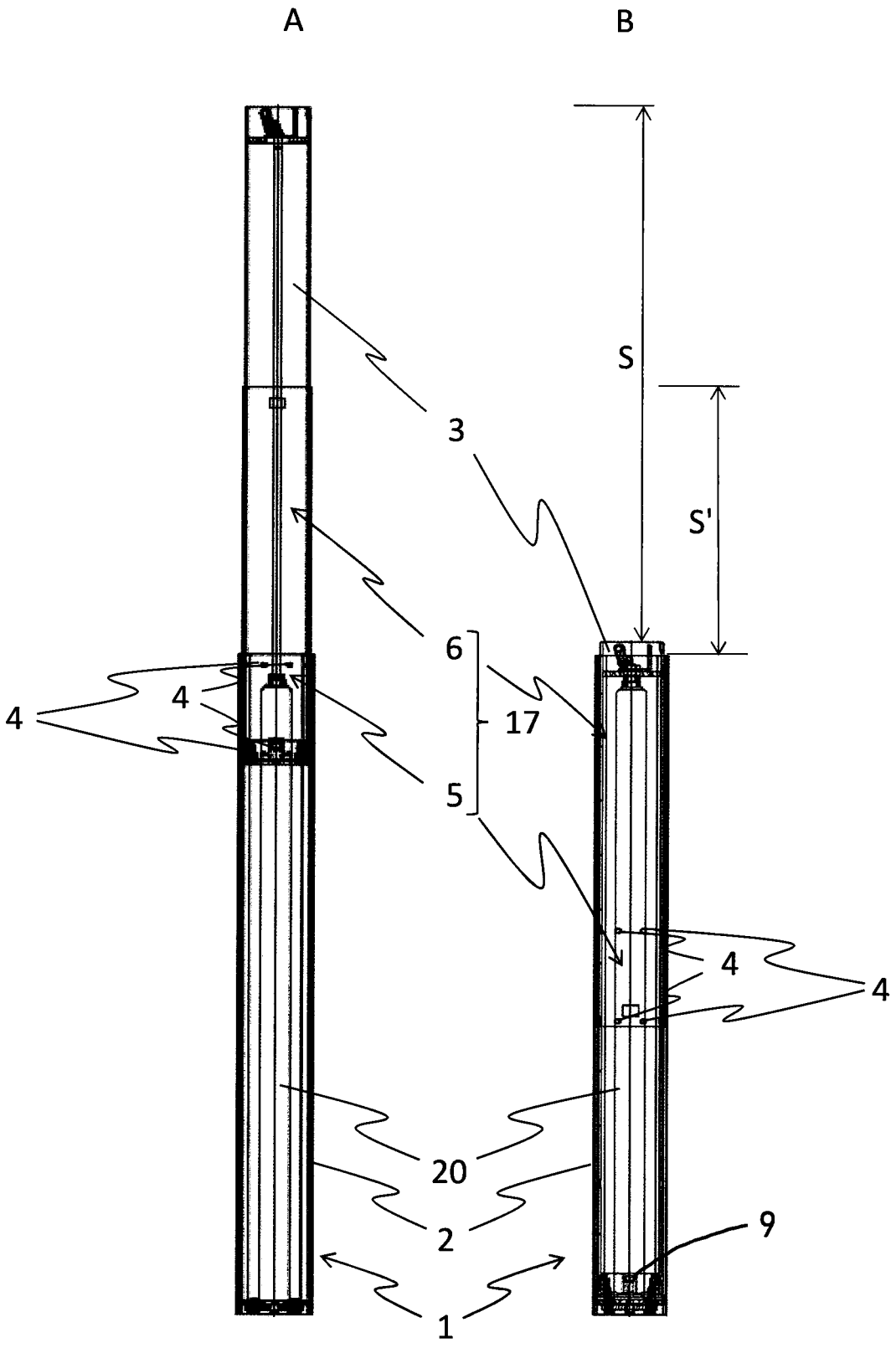
FIG. 1A shows a cross-sectional illustration of a telescopic column according to the invention in an extracted state.
FIG. 1B shows a cross-sectional illustration of the telescopic column according to the invention in a retracted state.

FIG. 1 shows a telescopic column 1 according to the invention for a height-adjustable table (not shown). In FIG. 1A, a cross-sectional illustration of the telescopic column 1 in an extracted state is shown and, in FIG. 1B, a cross-sectional illustration of the telescopic column 1 in a retracted state is shown.

The telescopic column 1 comprises a cylindrical outer column 2 and a cylindrical inner column 3 which is at least partially arranged within the outer column 2. The outer column 2 and the inner column 3 respectively have a circular outer cross-section in which, as the case may be, orifices can be provided. In the inner column 3, a lockable gas spring is provided as drive 20. In alternative embodiments, other kinds of drives, e.g., an electric linear drive, can be provided. A guiding ring 9 is fitted to the lower end of the telescopic column 1 illustrated in FIG. 1B.

Further, the telescopic column 1 comprises several balls 4. Due to clarity, not all of the balls 4 are provided with a reference sign.

Moreover, the telescopic column 1 comprises a tube-shaped ball cage 5 as being an integral element 17 which is integrally formed with a tube-shaped cover element 6. The ball cage 5 retains the balls 4 at positions predetermined relatively with respect to one another. Basically the ball cage 5 retains the balls 4 at a predefined distance in a longitudinal direction of the telescopic column 1. This distance has to be maintained in order to maintain a sufficient supporting distance between the balls 4, wherein a stiffness of the telescopic column 1 is ensured. Moreover, the balls 4 are retained at predefined positions on the circumference of the tube-shaped ball cage 4 in order to roll over in running surface sections described below. The running surface sections are predefined ranges of motion of the balls 4 of the outer column 2 and of the inner column 3 where the balls 4 roll over during the motion of the inner column 3 with respect to the outer column 2 from the extracted state to the retracted state and back.

Except from that, in FIG. 1, it can be seen that, upon a displacement stroke S of the inner column 3 from the retracted state to the extracted state of the telescopic column 1, the integral element 17 travels a distance S' which theoretically is the half of the displacement stroke S. The distance S' corresponds to a range of motion in which the balls 4 are moved on the outer column 2 and the inner column 3 in order to guide the inner column 3 in the outer column 2 for the displacement stroke S.

Figure 2:
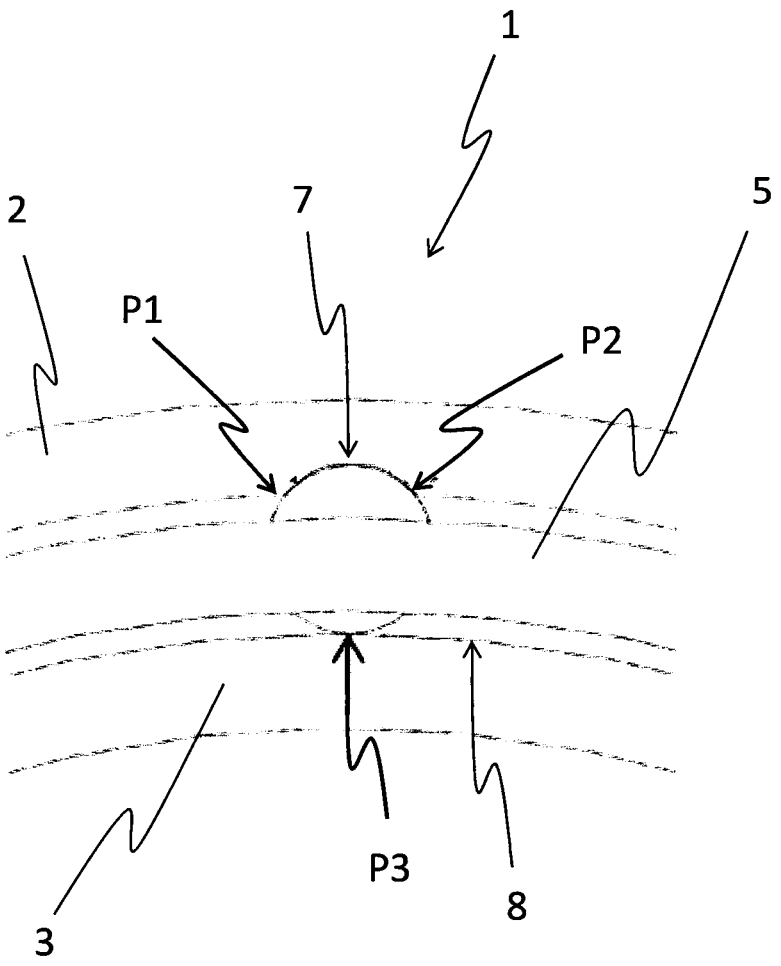
FIG. 2 shows a view of a section of a circumference of the telescopic column.

FIG. 2 shows a section of a circumference of the telescopic column 1. Thereby, a section of a circumference of the outer column 2 and of the inner column 3 are illustrated. Further, a section of a circumference of the tube-shaped ball cage 5 is illustrated, wherein, it is also shown that one of the balls 4 is retained at a predetermined position.

In this illustration, it can also be seen that, along its longitudinal direction on its inside, the outer column 2 has an outer column running surface section 7 in the form of a longitudinal groove. Since only a portion of the circumference of the telescopic column 1 is shown here, only one longitudinal groove can be seen. Actually, in this embodiment, sixteen longitudinal grooves are provided. Here, the longitudinal groove has a shape of almost a segment of a circle, wherein a diameter of the segment of the circle is different from a diameter of the ball 4, in particular, it is smaller, so that the ball 4 contacts the longitudinal groove at two contact points P1, P2 and rolls over on the outer column running surface section 7 in the range of motion of the ball 4 during an adjustment of the length of the telescopic column 1. In alternative embodiments, the longitudinal groove has such cross-section, namely a cross-section having a larger diameter, that the ball 4 contacts the longitudinal groove only at one contact point, or such that a line contact exists, namely, when the diameters are equal. In further alternative embodiments, the longitudinal groove can also have another cross-section than the cross-section of the segment of the circle, wherein, nevertheless, the ball 4 contacts the longitudinal groove at one contact point or at two contact points. In yet further alternative embodiments, not sixteen longitudinal grooves are provided as being the outer column running surface section 7 but another suitable quantity, wherein at least two longitudinal grooves are provided.

Further, it can be seen in this illustration that, along its longitudinal direction on its outer cross-section, the inner column 3 comprises an inner column running surface section 8 which is formed by the outer surface of the inner column 3. The shown ball 4 contacts the inner column running surface section 8 at one point P3 and rolls over thereon in a backlash-free manner in the range of motion of the shown ball 4 during the adjustment of the length of the telescopic column 1. The characteristic that the balls 4 roll over in a backlash-free manner on the inner column running surface section 8 and also on the above-mentioned outer column running surface section 7 means that, within the tolerances, the balls 4 maximally have a backlash which cannot or can hardly be recognized during moving a tabletop of the height-adjustable table without jamming of the balls 4 between the outer column running surface section 7 and the inner column running surface 8. Thereto, the outer column running surface section 7 and the inner column running surface section 8 comprise a surface, the roughness thereof is such low that the balls can smoothly roll over thereon, wherein a hardness of the surface is chosen such that the balls do not dent, e.g., when a rotary moment due to a load on the tabletop is exerted, however, slight wear traces of the balls 4 can be visible after a certain time of operation. Furthermore, the outer column running surface section 7 and the inner column running surface section 8 are aligned in parallel in a tolerance range which is chosen such that, during the adjustment of the length of the telescopic column 1, a force onto the balls in an unloaded state is almost equal.

Figure 3:
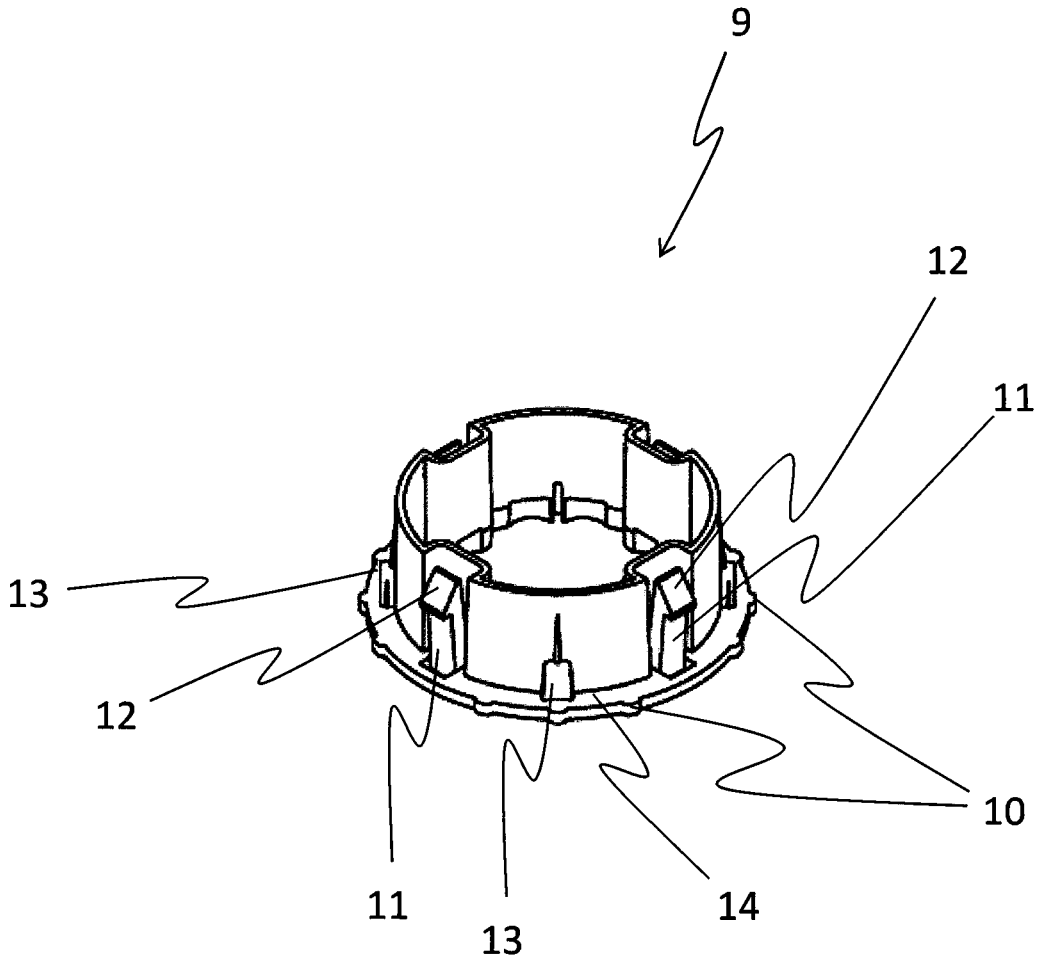
FIG. 3 shows a guiding ring.

FIG. 3 shows the guiding ring 9 having twelve guiding elements 10, wherein, due to clarity, not all of the guiding elements 10 are provided with a reference sign. In alternative embodiments, another quantity of guiding elements 10 is provided, wherein at least one guiding element 10 has to be provided.

The guiding elements 10 engage into one of the longitudinal grooves in an almost backlash-free manner during the adjustment along the adjustment stroke of the telescopic column 1 in order to align the inner column 3 with respect to the outer column 2. The longitudinal grooves have to have form features which ensure the almost backlash-free characteristic of the guiding elements 10 in the region in which the guiding elements 10 move. Here, the almost backlash-free characteristic refers to a backlash in the circumferential direction of the telescopic column 1 since the alignment is ensured by a contact of the side surfaces of the guiding elements 10 with flanks of the longitudinal grooves. Also in this case, the almost backlash-free characteristic means that maximally such a backlash exists that twisting of the inner column 3 with respect to the outer column 2 is scarcely perceptible and without jamming of the guiding elements 10 in the longitudinal grooves.

As shown in FIG. 3, the guiding elements 10 are integrally connected with one another and form the guiding ring 9. In alternative embodiments, in particular, if only one guiding element 10 is provided, the guiding element 10 is directly connected to the inner column 3.

The guiding ring 9 comprises four radial protrusions 11 respectively provided with a snap-in nose 12, the function of which is described below. Moreover, the guiding ring 9 comprises four further radial protrusions 13. In alternative embodiments, another suitable quantity of the radial protrusions 11 and of the further radial protrusions 13 is provided, wherein the radial protrusions 11 and the further radial protrusions 13 are not imperatively provided if their function described below can be fulfilled in another manner.

Finally, the guiding ring 9 comprises a circumferential, radially protruding rim 14. On the rim 14, the guiding elements 10 are provided on its circumference. In alternative embodiments, the rim 14 is not provided in a circumferential manner but only in angle sections on the circumference of the guiding ring 9 or no rim 14 is provided and, as the case may be, the guiding elements 10 takeover the function described later of the rim 14.

Figure 4:
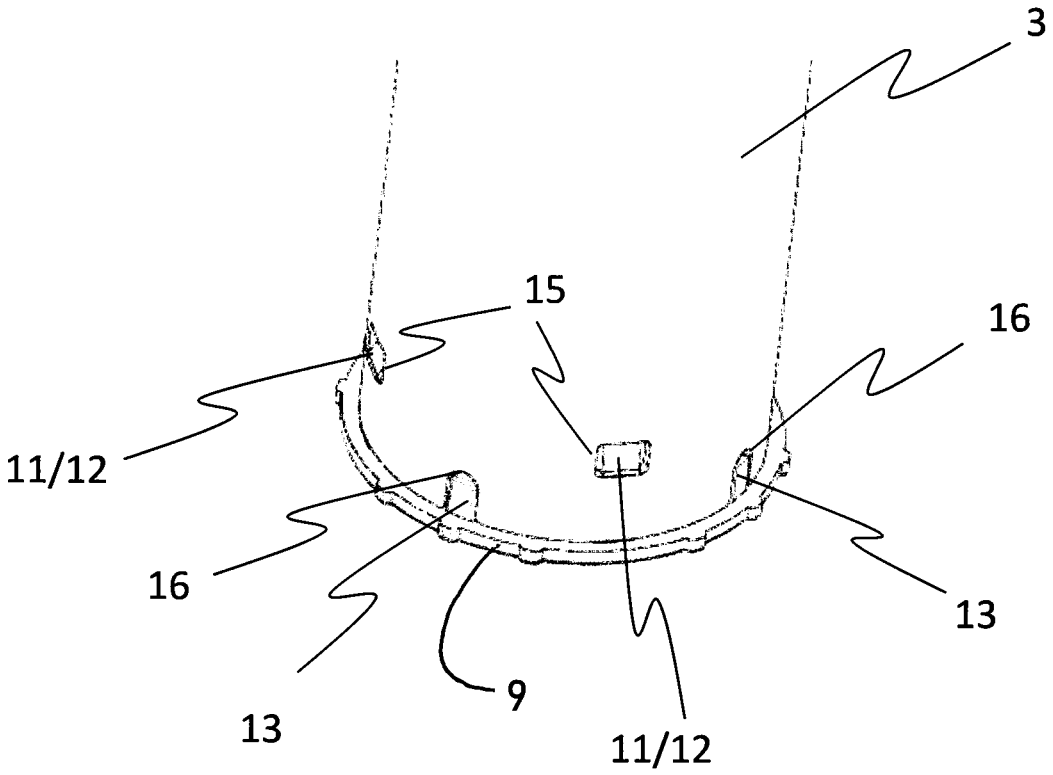
FIG. 4 shows a lower section of the inner column with the mounted guiding ring.

FIG. 4 shows a lower section of the inner column 3 with a mounted guiding ring 9.

Distributed along its circumference, the inner column 3 comprises four recesses 15. The radial protrusions 11 of the guiding ring 9 engage into the recesses 15. By the engaging of the radial protrusions 11, in particular, by the engaging of the snap-in noses 12, into the recesses 15, the guiding ring 9 is fastened to the inner column 3. The fastening is particularly done such that the rim 14 of the guiding ring 9 abuts against one end face of the inner column 3 in the axial direction of the inner column 3 and the snap-in nose 12 of the radial protrusion 11 comes in engagement with the recess 15 such that the guiding ring 9 is positively retained in the longitudinal direction of the inner column 3 by means of the rim 14 and the snap-in nose 12.

Further, distributed along its circumference, the inner column 3 comprises four further recesses 16. The further radial protrusions 13 of the guiding ring 9, also shown in FIG. 3, engage with the further recesses 16 in order to positively align the guiding ring 9 with respect to the inner column 3.

In alternative embodiments, another quantity of the recesses 15, the further recesses 16, the radial protrusions 11, and the further radial protrusions 13 is provided, wherein at least one of the recesses 15 and the further recesses 16 and one of the radial protrusions 11 and the further radial protrusions 16 is respectively provided. In the shown embodiment, the functions of the alignment of the guiding ring 9 with respect to the inner column 3 and the retaining of the guiding ring 9 on the inner column 3 is respectively divided to the combinations "radial protrusions 11/recesses 15" and "further radial protrusions 13/further recesses 16". In alternative embodiments, these functions can, for example, also be realized by the combination "radial protrusions 11/recesses 15" or, further alternatively, in another manner so that the radial protrusions 11, the further radial protrusions 13, the recesses 15, and the further recesses 16 are not provided.

Figure 5:
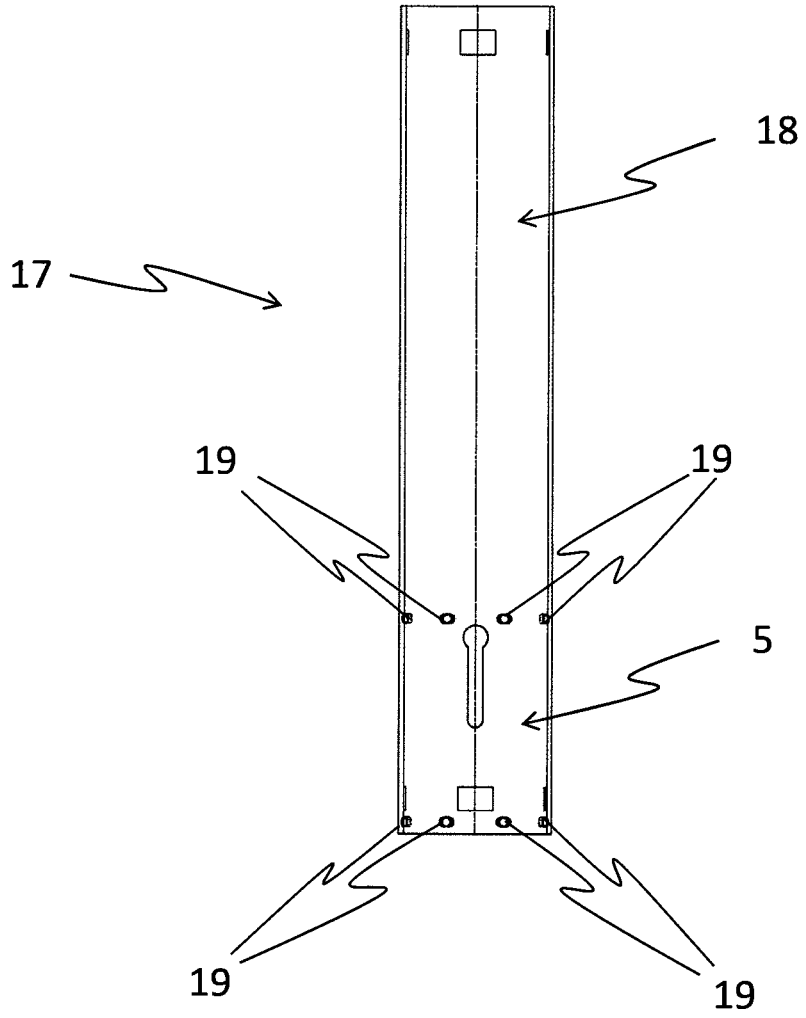
FIG. 5 shows an integral part having a ball cage and a tube-shaped cover element.

FIG. 5 shows the integral part 17 comprising the tube-shaped cover element 18 integrally connected with the ball cage 5. The tube-shaped cover element 18 has an inner diameter which is slightly larger than an outer diameter of the inner column 3 so that it can move with respect to the inner column 3. Further, the tube-shaped cover element 18 has a length so that, in an extracted state of the telescopic column 1, the cover element 18 covers at least the inner column running surface section 8, therefore, the predetermined range of motion of the balls 4. For the integral part 17, the ball cage 5 and the tube-shaped cover element 18 are made of the same material, particularly of metal, more particular, of a plastic-coated aluminum continuous casting, in one piece. In alternative embodiments, the ball cage 5 and the tube-shaped cover element 18 can be made of different materials which, then, are combined to the integral part 17, for example, welded or bonded. In further alternative embodiments, the ball cage 5 and the tube-shaped cover element 18 are separate parts which are then combined to one another by, e.g., clipping on. In other alternative embodiments, the integral part is not covered with plastic but it is entirely made of plastic.

The portion of the integral part 17 forming of the ball cage 5 comprises a tube-shaped cross-section. Further, it comprises orifices 19 in which the balls 4 are arranged such that they project on the inside as well as on the outer side of the ball cage 5. By the orifices 19, the balls 5 are retained at a defined distance in a longitudinal direction of the tube-shaped ball cage. Furthermore, the positions of the orifices 19 are chosen such that the balls 4 roll over on the outer column running surface section 7 and the inner column running surface section 8 in the mounted state of the ball cage 5.

As already can be seen in FIG. 2, the ball cage 5 has an inner diameter which is slightly larger than the outer diameter of the inner column 3 and an outer diameter which is smaller than an inner longitudinal hole of the outer column 2 and it is arranged in a gap between the outer column 2 and the inner column 3 so that it can move between the inner column and the outer column. These features are also valid for the column-shaped cover element 18. Since, as can be seen in FIG. 4, the outer diameter of the protruding rim 14 of the guiding ring 9 is larger than the outer diameter of the inner column 3, the guiding ring 9 projects into the gap shown in FIG. 2.

In use, the telescopic column 1 is moved from the retracted state (FIG. 1B) to the extracted state (FIG. 1A) by means of the drive 20. During the relative motion of the inner column 3 with respect to the outer column 2, the inner column 3 is guided in the outer column 2 in a backlash-free manner by the balls 4. By the rolling over of the balls 4 on the outer column running surface section 7 and the inner column running surface section 8, also the balls 4 move in the direction of motion of the inner column 3, however, due to the simultaneous rolling over of the balls 4 on the outer column running surface section 7 and the inner column running surface section 8, only with half the speed of the inner column 3 with respect to the outer column 2 and about the distance S', namely, half of the adjustment stroke S. Since, thereby, also the ball cage 5 and, therefore, the integral element 17 with also the cover element 18 are moved in the same direction as the inner column 3, nevertheless, half of the adjustment stroke S, on the one hand, the integral part 17 guides the balls with its ball cage 5 and retains them at a defined distance and, on the other hand, the integral part 17 with the cover element 18 covers the inner surface running surface section 8.

During the relative motion of the inner column 3 with respect to the outer column 2 from the extracted state (FIG. 1A) to the retracted state (FIG. 1B), the balls 4 then move together with the ball cage 5, therefore, with the integral element 17 again at half the speed about the half of the adjustment stroke S in the direction towards the retracted state of the telescopic column 1.

When, due to the slip of the balls 4 caused, for example, by the gravity force, the balls 4 together with the ball cage 5, therefore, with the integral element 17, do not travel the half of the adjustment stroke S, there is the risk that also the cover element 18 does not travel the necessary stroke so that the inner column running surface section 8 is not completely covered. This is prevented thereby that the ball cage 5 and, therefore, also the integral element 17 with the cover element 18 can abut against the radial rim 14 of the guiding ring 9 fastened to the inner column 3 when the length of the telescopic column 1 is increased and, therefore, the cover element 18 is forcedly brought into the necessary position so that the inner column running surface section 8 is completely covered.

Although the present invention has been described with reference to certain features and embodiments, it is apparent that various modifications and combinations may be made thereto without departing from the spirit and the scope of the invention. The description and the drawings are accordingly to be considered merely as an illustration of the invention as defined by the appended claims, and are intended to cover all of the modifications, variations, combinations or equivalents which fall within the scope of the present invention.

The invention claimed is:

1. A telescopic column for a height-adjustable table, wherein the telescopic column comprises:

a cylindrical outer column having a circular outer cross-section and a circumference, a cylindrical inner column, having a circular outer cross-section, the cylindrical inner column being at least partially arranged within the outer column, several balls, and a tube-shaped ball cage configured to retain the balls at predetermined positions, wherein the outer column, along a longitudinal direction of the outer column on an inside of the outer column, comprises an outer column running surface section configured such that the balls roll over thereon, the inner column, along a longitudinal direction of the inner column on an outer cross-section of the inner column, comprises an inner column running surface section configured such that the balls roll over thereon, and the inner column and the outer column are configured such that the balls roll over in an at least almost backlash-free manner on the outer column running surface section and the inner column running surface section during an adjustment of a length of the telescopic column in a predefined range of motion of the balls in order to guide the inner column in the outer column, the outer column running surface section comprises, along the longitudinal direction of the outer column and distributed on the circumference of the cylindrical outer column, at least two longitudinal grooves respectively configured such that the balls can roll over in the longitudinal grooves during the adjustment in the range of motion, wherein the telescopic column further comprises a tube-shaped cover element which covers the inner column running surface section of the cylindrical inner column that is partially arranged within the outer column, the cover element being combined with the ball cage and thereby being positioned between the inner and outer columns, the cover element and the ball cage being moved together when the telescopic column is in an extracted state wherein the running surfaces on the inner column are coverable by the cover element and wherein the cover element covers at least the predetermined range of motion of the balls of the inner column running surface section when in the extracted state of the telescopic column such that the inner column running surface is not visible when the telescope column is in the extracted state.

2. The telescopic column according to claim 1, wherein a shape and dimensions of the at least two longitudinal grooves within the predefined range of motion of the balls as well as a diameter of the balls are configured such that, during the adjustment of the length of the telescopic column, one of the balls contacts one of the at least two longitudinal grooves at two points.

3. The telescopic column according to claim 1, wherein the inner column comprises at least one guiding element configured such that the at least one guiding element engages into one of the at least two longitudinal grooves in an at least almost backlash-free manner during the adjustment of the length of the telescopic column along an adjustment stroke of the telescopic column in order to align the inner column with respect to the outer column.

4. The telescopic column according to claim 3, wherein the at least one guiding element comprises several guiding elements configured such that the several guiding elements engage into at least one of the at least two longitudinal grooves in an at least almost backlash-free manner during the adjustment of the length of the telescopic column along the adjustment stroke are provided.

5. The telescopic column according to claim 4, wherein the several guiding elements are integrally connected to one another, and the several guiding elements are configured to form a guiding ring.

6. The telescopic column according to claim 5, wherein the inner column comprises a recess, the guiding ring comprises a radial protrusion, and the recess and the radial protrusion are configured such that the recess and the first radial protrusion engage into one another.

7. The telescopic column according to claim 6, wherein the guiding ring comprises an at least partially circumferential, radially protruding rim, and the several guiding elements are integrated in the rim of the guiding ring.

8. The telescopic column according to claim 7, wherein the telescopic column is configured such that the rim of the guiding ring abuts against an end face of the inner column, and the radial protrusion comprises a snap-in nose configured such that it engages with the recess of the inner column such that the guiding ring is positively retained in the longitudinal direction of the inner column by the rim of the guiding ring and the snap-in nose.

9. The telescopic column according to claim 8, wherein the inner column comprises a further recess, the guiding ring comprises a further radial protrusion, and the further recess and the further radial protrusion are configured such that the further recess and the further radial protrusion engage into one another in order to positively align the guiding ring with respect to the inner column.

10. The telescopic column according to claim 7, wherein the telescopic column is configured such that the ball cage can abut against the rim when the length of the telescopic column is increased.

11. The telescopic column according to claim 1, wherein the cover element and the ball cage are formed as being an integral part.

12. The telescopic column according to claim 1, wherein the cover element and the ball cage are made of a same material.

13. A height-adjustable table comprising a telescopic column according to claim 1.

14. The telescopic column according to claim 1, wherein the inner column comprises at least one guiding element configured such that the at least one guiding element engages into one of the at least two longitudinal grooves in an at least almost backlash-free manner during the adjustment of the length of the telescopic column along an adjustment stroke of the telescopic column in order to align the inner column with respect to the outer column.

15. The telescopic column according to claim 14, wherein the at least one guiding element comprises several guiding elements configured such that the several guiding elements engage into at least one of the at least two longitudinal grooves in an at least almost backlash-free manner during the adjustment along the adjustment stroke are provided.

16. The telescopic column according to claim 15, wherein the several guiding elements are integrally connected to one another, and the several guiding elements are configured to form a guiding ring.

17. The telescopic column according to claim 16, wherein the inner column comprises a recess, the guiding ring comprises a radial protrusion, and the recess and the radial protrusion are configured such that the recess and the radial protrusion engage into one another.

18. The telescopic column according to claim 17, wherein the guiding ring comprises an at least partially circumferential, radially protruding rim, and the guiding elements are integrated in the rim.

19. The telescopic column according to claim 1, wherein the telescopic column further comprises a tube-shaped cover element provided combined with the ball cage, and which cover element is configured to move together with the ball cage half of an adjustment stroke of the inner column with respect to the outer column to cover at least the predetermined range of motion of the balls of the inner column running surface section in an extracted state of the telescopic column such that the inner column running surface is not visible also in case of the extracted telescope column.

20. A telescopic column for a height-adjustable table, wherein the telescopic column comprises:

a cylindrical outer column having a circular outer cross-section and a circumference, a cylindrical inner column, having a circular outer cross-section, the cylindrical inner column being at least partially arranged within the outer column, several balls, and a tube-shaped ball cage configured to retain the balls at predetermined positions, wherein the outer column, along a longitudinal direction of the outer column on an inside of the outer column, comprises an outer column running surface section configured such that the balls roll over thereon, the inner column, along a longitudinal direction of the inner column on an outer cross-section of the inner column, comprises an inner column running surface section configured such that the balls roll over thereon, and the inner column and the outer column are configured such that the balls roll over in an at least almost backlash-free manner on the outer column running surface section and the inner column running surface section during an adjustment of a length of the telescopic column in a predefined range of motion of the balls in order to guide the inner column in the outer column, the outer column running surface section comprises, along the longitudinal direction of the outer column and distributed on the circumference of the cylindrical outer column, at least two longitudinal grooves respectively configured such that the balls can roll over in the longitudinal grooves during the adjustment in the range of motion, wherein the telescopic column further comprises a tube-shaped cover element which covers the inner column running surface section of the cylindrical inner column that is partially arranged within the outer column, the cover element being combined with the ball cage and thereby being positioned between the inner and outer columns, the cover element and the ball cage being moved together when the telescopic column is in an extracted state wherein the running surfaces on the inner column are coverable by the cover element and wherein the cover element covers at least the predetermined range of motion of the balls of the inner column running surface section when in the extracted state of the telescopic column such that the inner column running surface is not visible when the telescope column is in the extracted state, wherein the inner column comprises at least one guiding element is configured such that the at least one guiding element engages into one of the at least two longitudinal grooves in an at least almost backlash-free manner during the adjustment of the length of the telescopic column along an adjustment stroke of the telescopic column in order to align the inner column with respect to the outer column.

* * * * *